US008439103B2

(12) United States Patent
Reinders

(10) Patent No.: US 8,439,103 B2
(45) Date of Patent: May 14, 2013

(54) HEAT EXCHANGER AND METHOD FOR MANUFACTURING THEREOF

(75) Inventor: Johannes Antonius Maria Reinders, Warnsveld (NL)

(73) Assignee: Oxycom Beheer B.V., Raalte (NL)

( * ) Notice: Subject to any disclaimer, the term of this patent is extended or adjusted under 35 U.S.C. 154(b) by 0 days.

(21) Appl. No.: 12/795,890

(22) Filed: Jun. 8, 2010

(65) Prior Publication Data

US 2010/0243222 A1 Sep. 30, 2010

Related U.S. Application Data

(63) Continuation of application No. 10/512,482, filed as application No. PCT/NL03/00151 on Feb. 27, 2003, now abandoned.

(30) Foreign Application Priority Data

Apr. 26, 2002 (NL) ..... 1020483

(51) Int. Cl.
*F28F 3/00* (2006.01)
*F28D 7/02* (2006.01)

(52) U.S. Cl.
USPC ..... 165/166; 165/165

(58) Field of Classification Search ..... 165/165, 165/166, 167, 149, 153, 82, 179, 182
See application file for complete search history.

(56) References Cited

U.S. PATENT DOCUMENTS

| | | | | |
|---|---|---|---|---|
| 2,472,413 | A | 7/1949 | Gantvoort | |
| 2,656,160 | A * | 10/1953 | Lyerly et al. | 165/170 |
| 3,021,804 | A | 2/1962 | Simpelmr | |
| 3,372,743 | A | 3/1968 | Pall et al. | |
| 3,460,611 | A * | 8/1969 | Tramuta et al. | 165/166 |
| 3,528,496 | A | 9/1970 | Kun | |
| 3,847,211 | A * | 11/1974 | Fischel et al. | 165/166 |
| 4,075,091 | A | 2/1978 | Bellhouse | |
| 4,158,679 | A | 6/1979 | Yeagle | |
| 4,253,520 | A | 3/1981 | Friedericy et al. | |
| 4,263,964 | A | 4/1981 | Masai et al. | |
| 4,419,300 | A | 12/1983 | Van Ness et al. | |
| 4,601,089 | A * | 7/1986 | Gal | 29/890.042 |

(Continued)

FOREIGN PATENT DOCUMENTS

| | | |
|---|---|---|
| BE | 1013160 | 10/2001 |
| FR | 1389833 | 1/1965 |

(Continued)

OTHER PUBLICATIONS

Summary of Manufacturing and Application of Composite Material Carbon Fiber.

(Continued)

*Primary Examiner* — Tho V Duong
(74) *Attorney, Agent, or Firm* — Coraline J. Haitjema; David P. Owen; Hoyng Monegier LLP

(57) ABSTRACT

A heat exchanger comprising two sets of medium through-flow channels through which two media can flow in heat-exchanging contact. Walls separating the channels are provided with heat conducting fins arranged on both sides of each wall, wherein a fin on the one side of a wall is in thermal contact with a similar fin on the other side of this wall.

13 Claims, 14 Drawing Sheets

U.S. PATENT DOCUMENTS

| | | | | |
|---|---|---|---|---|
| 4,616,695 | A | 10/1986 | Takahashi et al. | |
| 4,674,295 | A | 6/1987 | Curtis | |
| 5,287,918 | A * | 2/1994 | Banks et al. | 165/166 |
| 5,349,829 | A | 9/1994 | Tsimerman | |
| 5,490,559 | A | 2/1996 | Dinulescu | |
| 5,626,188 | A | 5/1997 | Dewar et al. | |
| 5,720,407 | A | 2/1998 | Hoffman | |
| 6,019,170 | A | 2/2000 | Yokoya et al. | |
| 6,233,824 | B1 | 5/2001 | Dobbs | |
| 6,267,175 | B1 | 7/2001 | Anderson | |
| 6,332,332 | B1 | 12/2001 | O'Brien | |
| 6,338,258 | B1 | 1/2002 | Lee et al. | |
| 6,427,764 | B2 * | 8/2002 | Nash | 165/82 |
| 2002/0005279 | A1 * | 1/2002 | Maute | 165/148 |

FOREIGN PATENT DOCUMENTS

| | | | |
|---|---|---|---|
| FR | 2846661 | | 10/1977 |
| GB | 909142 | | 10/1962 |
| GB | 1419490 | | 12/1975 |
| GB | 2132748 | | 11/1984 |
| GB | 2197450 | A | 5/1988 |
| JP | 56027892 | A | 3/1981 |
| JP | 58198696 | A | 11/1983 |
| JP | 03230096 | A * | 10/1991 |
| NL | 1018735 | | 6/2001 |
| TW | 439975 | | 7/2001 |
| WO | 9104451 | A1 | 4/1991 |
| WO | 0127552 | A1 | 4/2001 |
| WO | 0227254 | | 4/2002 |

OTHER PUBLICATIONS

Study & Development of the surface coating on Aluminium Foil Heat Exchanger Fin Materials for Air Conditioner.

* cited by examiner

HEAT EXCHANGER AND METHOD FOR MANUFACTURING THEREOF

CROSS REFERENCE TO RELATED APPLICATIONS

This application claims priority from Dutch application number 1020483 filed on 26 Apr. 2002, and is a continuation of U.S. application Ser. No. 10/512,482 which was filed on 8 Jul. 2005 based on international application no. PCT/NL03/00151, the contents of which are hereby incorporated by reference in their entirety.

BACKGROUND OF THE INVENTION

1. Field of the Invention

The invention relates to heat exchangers and more particularly to counter-flow heat exchangers of the type comprising two sets of medium through-flow channels which are placed mutually interlaced and through which two media can flow physically separated from each other but in heat-exchanging contact.

2. Description of the Related Art

Such heat exchangers are known in many embodiments and comprise walls separating said channels with heat-conducting fins arranged on both sides of each wall. The fins extend with their main planes in the respective flow directions of said media, wherein a fin on the one side of a wall is in thermal contact with a fin on the other side of this wall. A housing may accommodate the walls with the fins and may be provided with inlets and outlets for the channels either individually per channel or commonly for the sets of channels via respective manifolds.

In known heat exchangers of this type, the walls and heat-conducting fins are manufactured of metal and joined together by welding, brazing or the like. Heat transfer may take place both through the wall and also along the wall by conduction. Such conduction in the plane of the wall can be detrimental to the efficiency of the heat exchanger.

BRIEF SUMMARY OF THE INVENTION

The present invention addresses certain problems of the prior art by providing a heat exchanger, comprising a plurality of walls of plastic material, the walls being held in spaced, generally parallel relation to form through-flow channels, heat-conducting metal fins arranged between adjacent walls, which fins have a width extending between the walls and a length defining a flow direction, the heat-conducting metal fins being generally parallel to one another and structurally connected to the respective adjacent walls to maintain said spaced parallel relation and wherein the fins on a first side of a wall are each aligned with and in direct thermal contact with a corresponding fin on a second side of that wall, whereby heat conduction can take place from fin to fin through the wall, wherein the fins are arranged in a plurality of strips, spaced from one another in said flow direction and thermally separated by the plastic material of the wall, the fins in each strip being spaced from each other by a pitch distance and the fins in a first strip being offset from the fins in an adjacent strip by a fraction of the pitch distance. As a result of this configuration, the leading edge of each fin is always situated in a practically undisturbed flow, which enhances the heat transfer. Furthermore, the resulting heat exchanger may be very light and can be manufactured inexpensively, while nevertheless still having excellent efficiency.

According to another aspect of the invention, the walls may be embodied as membranes and the fins may be embodied as heat-transferring, for instance metal strips with a general wave shape, which fins are provided with contact surfaces connected to the walls and main planes extending between two walls, this such that, in addition to a thermal function, the fins also have a structural function. The coefficient of heat transfer of the whole separating wall preferably amounts to a minimum of 1 $W/m^2K$. The heat exchanger according to the invention thus derives its mechanical strength and rigidity substantially from the fins. According to the prior art the mechanical strength and rigidity of heat exchangers are not generally determined by fins but by the heat-exchanging walls. This requires the use of mechanically strong and therefore thick walls, which thereby have the inherent drawback of a greater thermal resistance, to the extent the same materials are used. The heat exchanger according to the present invention can combine high efficiency with a very compact construction.

In this context it should also be understood that in theoretical sense a membrane is an "infinitely thin" skin-like element, which has a negligible bending stiffness and can therefore only derive its stiffness from the fact that it is clamped on its ends, optionally in combination with a certain tensile stress in the form of a bias. When a pressure difference occurs between the primary circuit and the secondary circuit, a certain bending of a practical membrane cannot be wholly prevented. In practice, the pressure resistance of a heat exchanger according to the invention is limited to a value determined by the mechanical properties, such as the thickness of the material used, the tensile strength, the ability to stretch, the limit of stretch, the bias, the mutual distance between the walls and the like. When a bias is used, this forms an extra load on the wall material. The maximum tensile stress in the wall is therefore equal to the total maximal tensile stress minus the bias.

In order to make the heat transfer between the layers of fins as great as possible, an embodiment is recommended in which corresponding contact surfaces are in thermal contact via the wall.

In a practical embodiment the heat exchanger has the feature that the contact surfaces are adhered to the wall by means of an adhesive layer applied to at least one contact surface.

An alternative has the feature that corresponding contact surfaces are directly connected to each other via a perforation in the wall by means of an adhesive layer applied to at least one contact surface.

It will be apparent that it is essential that the thermal resistance formed by the wall and the glue layer must be as small as possible. In this respect these layers should preferably be thin.

In respect of the thermal contact between adjacent layers of fins, an embodiment is recommended in which the walls consist of PVC and the fins are connected to the walls by an ultrasonic treatment or a thermal treatment, in combination with pressure. The connection can for instance take place by welding, soldering or the like, in any case such that the thermal resistance formed by the adhesive is absent.

A preferred embodiment has the special feature that the housing is form-retaining and the walls are connected to the housing in manner resistant to tensile stress, such that the tensile stresses occurring in the walls as a result of a pressure difference between the two sets of channels can be absorbed by the housing.

Another embodiment has the feature that the walls are biased such that, at a preselected maximum permissible pressure difference between the two sets of medium through-flow channels, the bending of the wall between the free space defined by the contact surfaces of the fins i.e. the bending of the membrane occurring at the relevant pressure divided by the relevant mutual distance between the contact surfaces in question, amounts to a maximum of 2.5%.

In the embodiment in which corresponding contact surfaces are in thermal contact via the wall, the heat exchanger preferably has the feature that the thermal resistance of the wall transversely of its main plane amounts to a maximum of 0.1 of the thermal resistance in the case of direct contact between contact surfaces directed toward each other, and is therefore negligible.

The heat exchanger preferably has the feature that the thermal resistance of the wall in its main plane over the mutual distance between two fins adjoining in flow direction is at least 10 times greater than in the case of fins directly coupled to each other thermally.

A practical embodiment has the special feature that the walls consist of PET, for instance reinforced PET, are treated with a corona discharge, are then provided with a primer, followed by a glue layer for connection to the contact surfaces of the fins.

An alternative embodiment has the feature that the walls consist of PVC and that the fins are connected to the walls by an ultrasonic treatment or a thermal treatment, in combination with pressure.

A substantial improvement in the tensile strength relative to the usual wall materials is obtained with a heat exchanger which has the feature that the wall consists of a fiber-reinforced material, which fibers consist for instance of glass, boron, carbon. The fibers can for instance be embodied as fabric or as non-woven.

A great improvement of the thermal conductivity of the wall is realized with a heat exchanger which has the feature that the walls consist of a plastic in which aluminum powder is embedded.

In order to enable the heat exchanger to be maintenance-free and make it suitable for the most diverse applications, the heat exchanger can have the feature that the walls consist of PET, for instance reinforced PET, are treated with a corona discharge, are then provided with a primer, followed by a glue layer for connection to the contact surfaces of the fins.

A very practical embodiment has the special feature that the walls protrude outside the fins such that they can be connected to a frame, for instance in order to place them under bias, or such that the protruding wall parts can be thermally formed into interlacing units and manifolds for respectively joining together and separating again the sets of channels. This embodiment alleviates the problem of embodying an interlacing unit and manifold on both sides of the heat exchanger.

A determined embodiment has the feature that the heat exchanger is given a modular structure with blocks which can be releasably coupled to each other. Thus is achieved that the heat exchanger can be manufactured in different dimensions by making use of blocks, without substantial change-over of a production line being necessary for this purpose.

A particular embodiment has the feature that the layers are ordered in the sequence P, S, P, S, P, S and so on. Another embodiment has the feature that the layers are ordered in the sequence P, P, S, S, P, P and so on.

In order to limit the mechanical load on the walls as much as possible during production of the heat exchanger, a preferred embodiment has the special feature that the contact surfaces of the fins have rounded peripheral edges.

In an embodiment in which the wall consists of a fiber-reinforced material, the heat exchanger can have the special feature that the fibers have an anisotropic heat conduction, such as carbon fibers, wherein the heat conduction is smaller in the main plane of the wall than in transverse direction thereof. The tensile strength of the wall and thereby the pressure resistance of the heat exchanger is hereby substantially improved, and a very good heat contact between adjacent fins is also achieved.

A suitable choice of the wall material can be made with an eye to operating conditions and applications. Thermoplastic plastics as well as thermosets such as polyether imide are suitable. The wall materials can also be provided with a coating, for instance of another plastic, a silicon material or the like. In the case of fiber reinforcement the fibers can have diameters of a few microns.

Another choice of material for the wall is metal, in particular a plastic foil with a metal coating on at least one of the two sides.

A very simple solution to a possibly occurring corrosion problem consists of an anticorrosive coating applied to at least one of the two contact surfaces and for instance comprising a primer layer and/or an adhesive layer extending over the whole surface of the fins and optionally the wall.

A specific embodiment has the special feature that the adhesive layer is of the type which can be thermally activated and that the fins are adhered to the relevant wall and/or to an adjacent set of fins at the position of the contact surfaces by heating and pressure by means of a heated pressing punch.

In yet another variant the heat exchanger has the feature that the fins are provided on the side remote from said coating with a second coating which can withstand said heating and pressure.

BRIEF DESCRIPTION OF THE DRAWINGS

The features and advantages of the invention will be appreciated upon reference to the following drawings, in which.

DESCRIPTION OF ILLUSTRATIVE EMBODIMENTS

Figure 1:
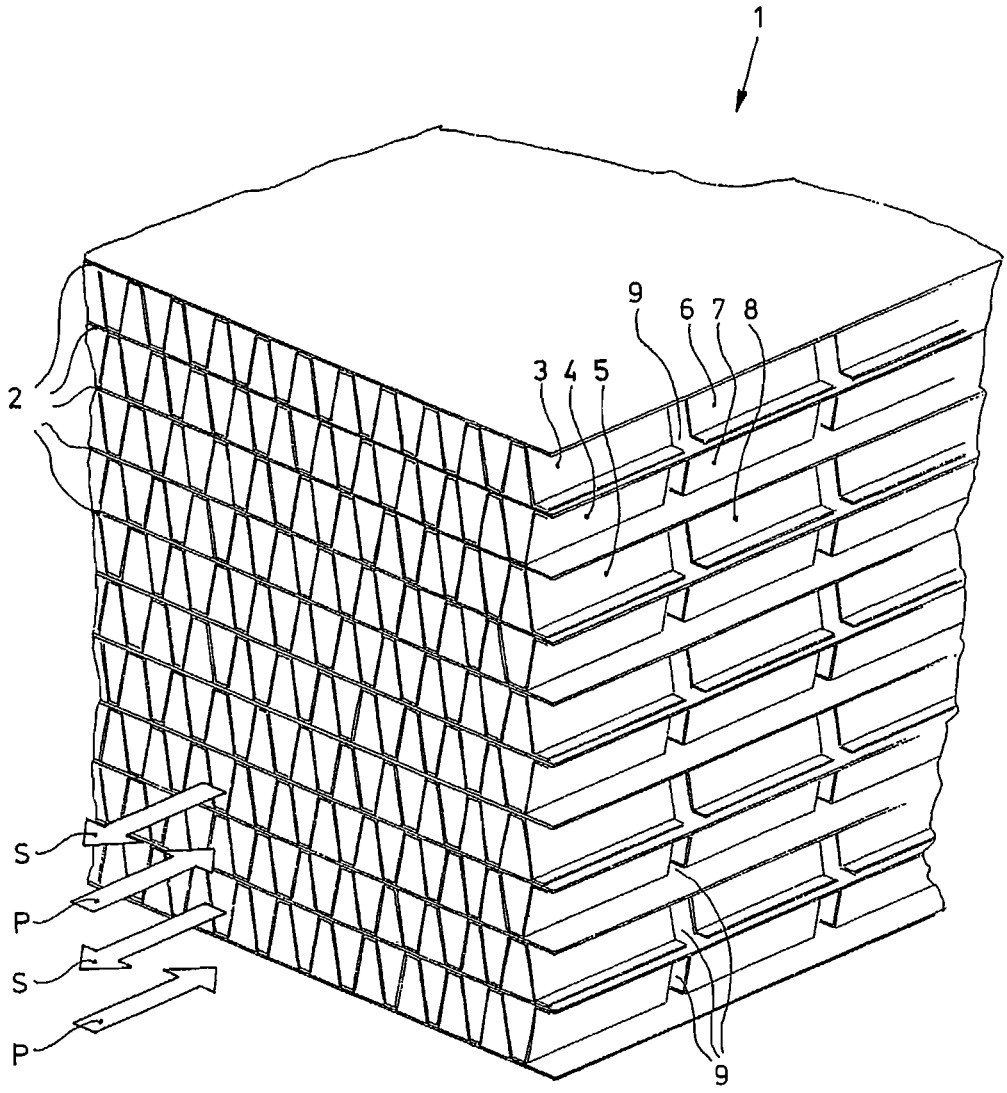
FIG. 1 shows a perspective partial view of a heat exchanger according to the invention, wherein the housing is not shown for the sake of clarity.

The following is a description of certain embodiments of the invention, given by way of example only and with reference to the drawings. Referring to FIG. 1, a heat exchanger 1 is shown, comprising a number of walls 2, between which extend respective strips 3, 4, 5, 6, 7, 8 and so on. These strips 3-8 form heat-conducting fins and are manufactured for this purpose from for instance copper.

By means of means to be described below the fins are adhered with their mutually facing contact surfaces to walls 2 on either side of these walls 2. In this embodiment the successive walls alternately bound a primary and a secondary circuit, designated in the figure with arrows P and S respectively. These medium circuits relate to the flow of media for placing in heat-exchanging contact with each other, for instance gaseous media, liquid media or respectively gas and liquid or two-phase media.

The drawing further shows that strips 3, 4, 5 have a limited length in the medium flow direction and that the subsequent fin strips 6,7, 8 are placed at a distance. This enhances the effective heat transfer. The intermediate space 9, which is not provided with fins, acts effectively as thermal separation in the transport direction. A prerequisite is that the wall material has limited heat conductivity and is for instance not manufactured from a good heat-conducting material such as copper. Plastic is for instance a very suitable choice. Because the walls are embodied as membranes and are therefore very thin, they present only a negligible thermal resistance at the position of the heat-transferring contact surfaces of the fins directed toward each other.

Figure 2A:
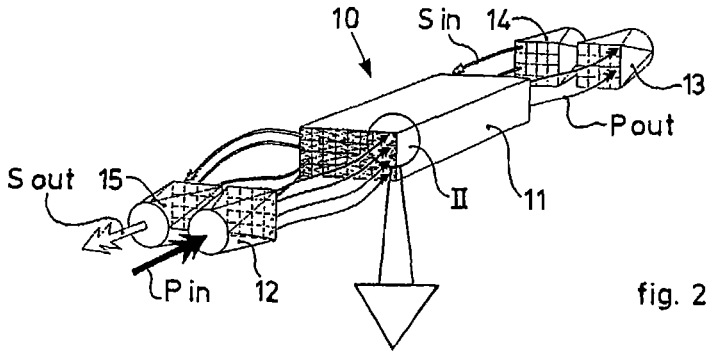
FIG. 2*a* shows a schematic perspective view on small scale of a heat exchanger according to the invention with a housing and interlacing units and manifolds.

FIG. 2 shows a heat exchanger 10 which is constructed on the basis of the above described membrane-fin-heat exchanger, wherein use is made of a housing. Connecting to the free ends are respective interlacing units and manifolds 12 for P in, 13 for P out, 14 for S in and 15 for S out.

Figure 2B:
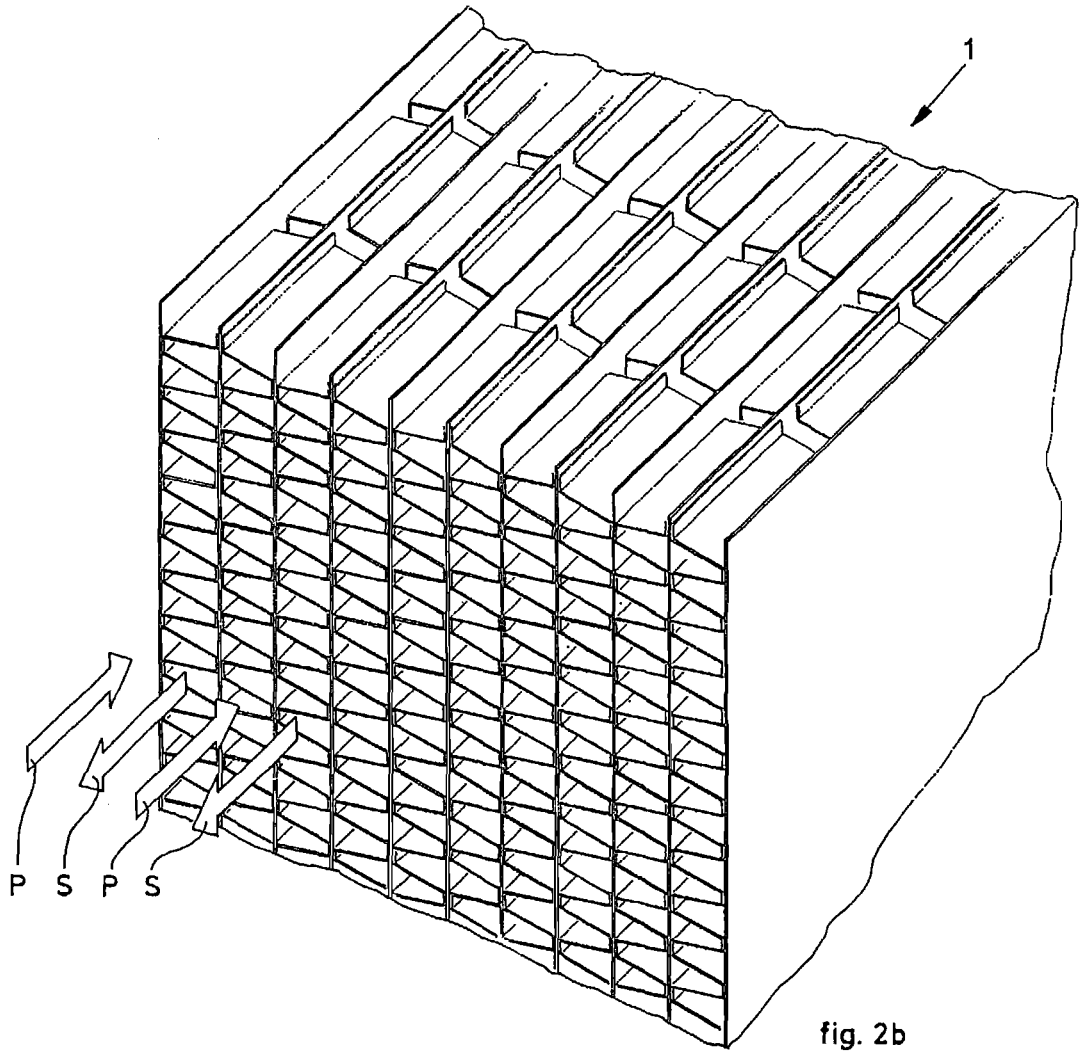
FIG. 2*b* shows the detail II of FIG. 2*a* on a larger scale.

FIG. 2*b* shows the interior of heat exchanger 10.

This is essentially the same unit as in FIG. 1 and is therefore also designated with reference numeral 1.

Figure 3:
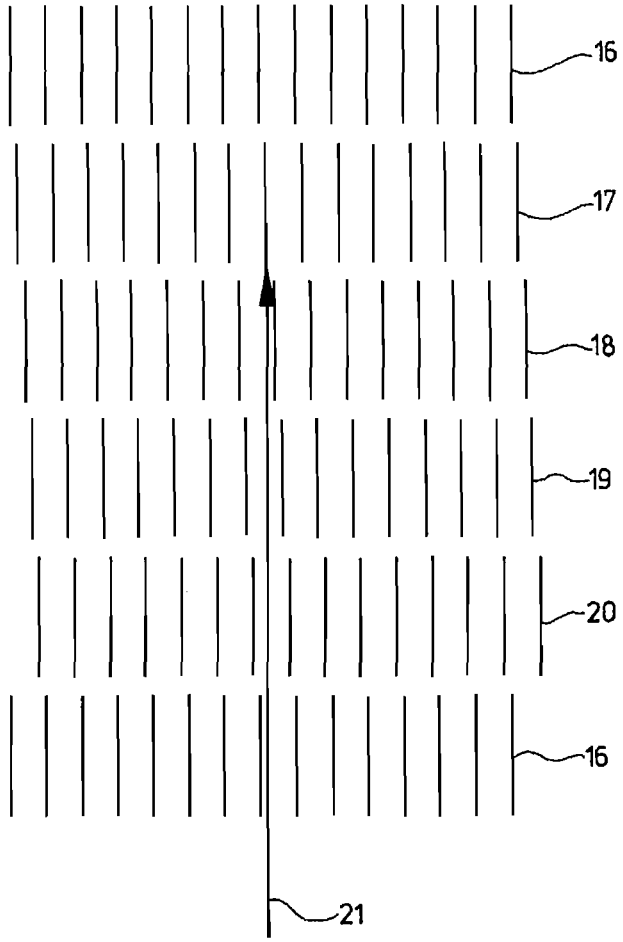
FIG. 3 is a schematic representation of an alternative offset arrangement of the fins.

FIG. 3 shows very schematically an alternative arrangement of fins in respective strips 16, 17, 18, 19, 20. It will be apparent that the fins are offset from one another by ⅕ the pitch distance in transverse direction relative to flow direction 21. The front edge of each fin is hereby always situated in a practically undisturbed flow. This enhances the heat transfer.

Figure 4:
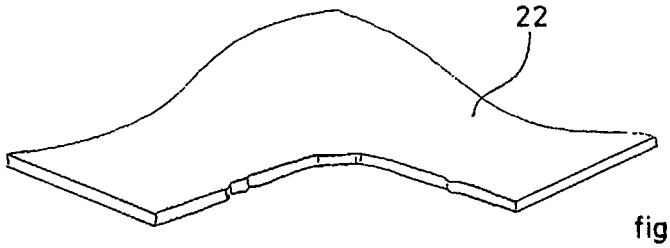
FIG. 4 is a schematic representation of an unreinforced membrane.

FIG. 4 shows a membrane 22 schematically.

Figure 5:
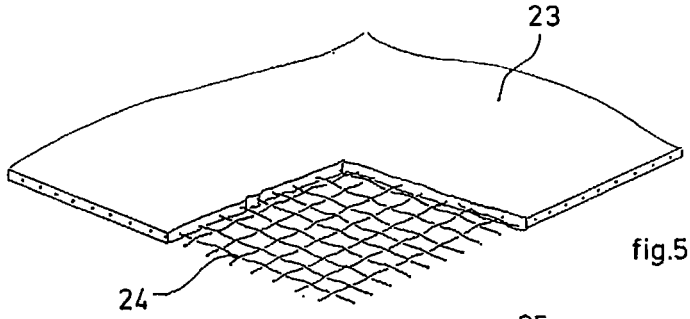
FIG. 5 shows a partly broken away perspective view of a membrane reinforced with a fiber fabric.

FIG. 5 shows a membrane 23 which is reinforced with a fabric 24, for instance consisting of glass fiber, carbon fiber or the like. It is noted that the drawing is not to scale and that a mat 24 of this type can also be impregnated with a plastic, whereby the fabric is medium-tight and can moreover melt, for instance through heat, for adhering to the contact surfaces of the fins.

Figure 6:
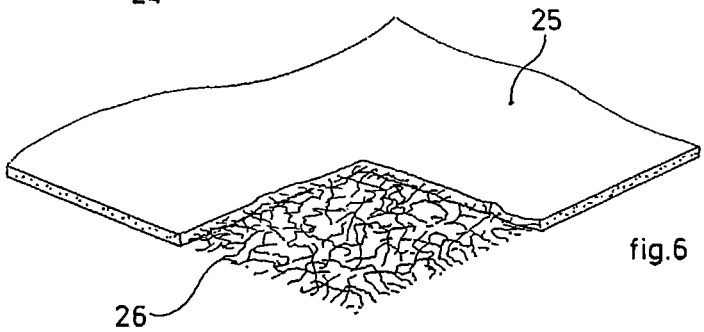
FIG. 6 shows a view corresponding with FIG. 5 of a membrane reinforced with a non-woven material.

FIG. 6 shows a membrane 25 with a non-woven reinforcement 26.

Figure 7A:
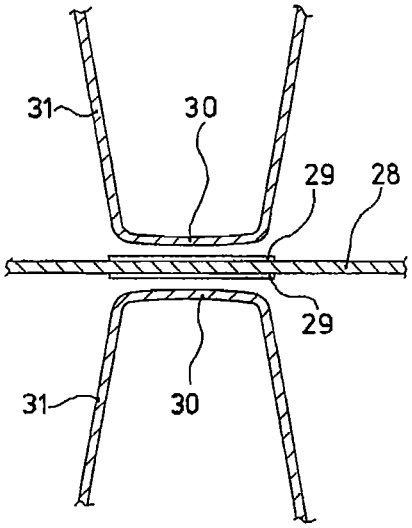
FIGS. 7*a* and 7*b* show respective phases of adhesion of the contact surfaces of fins to a membrane.
Figure 7B:
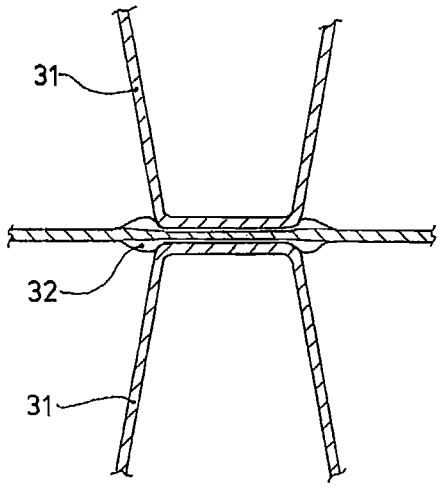

FIG. 7*a* shows a membrane 28 with glue layers 29 at the position of contact surfaces 30 of fins 31. The structure drawn in FIG. 7*b* is obtained by pressing, wherein the glue is pressed out slightly into side zones 32. The glue 29 can be pre-heated or be of the pressure-sensitive type.

Figure 8:
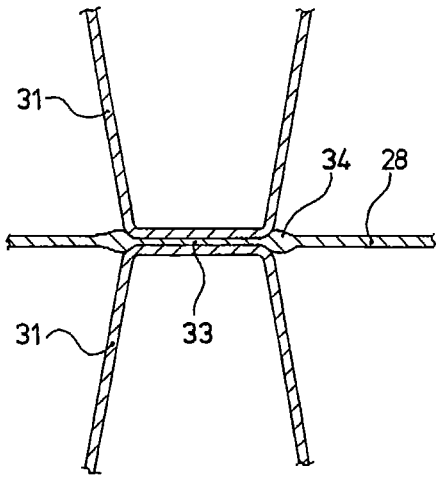
FIG. 8 shows an alternative method of adhesion.

FIG. 8 shows an embodiment wherein fins 31 are pressed into membrane 28 during heating and under pressure.

The membrane material is hereby made thinner in the intermediate zone 33 and the material is pressed slightly outward at the side in zones 34. This embodiment is favorable in the sense that a good seal is always ensured, while the already thin membrane material is made extra-thin.

Figure 9A:
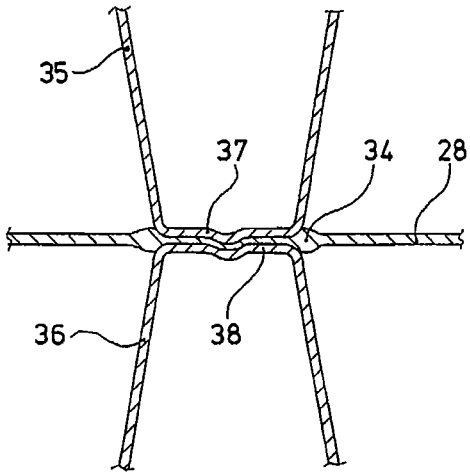
FIG. 9*a* shows a cross-section corresponding with FIG. 8 of an alternative form.
Figure 9B:
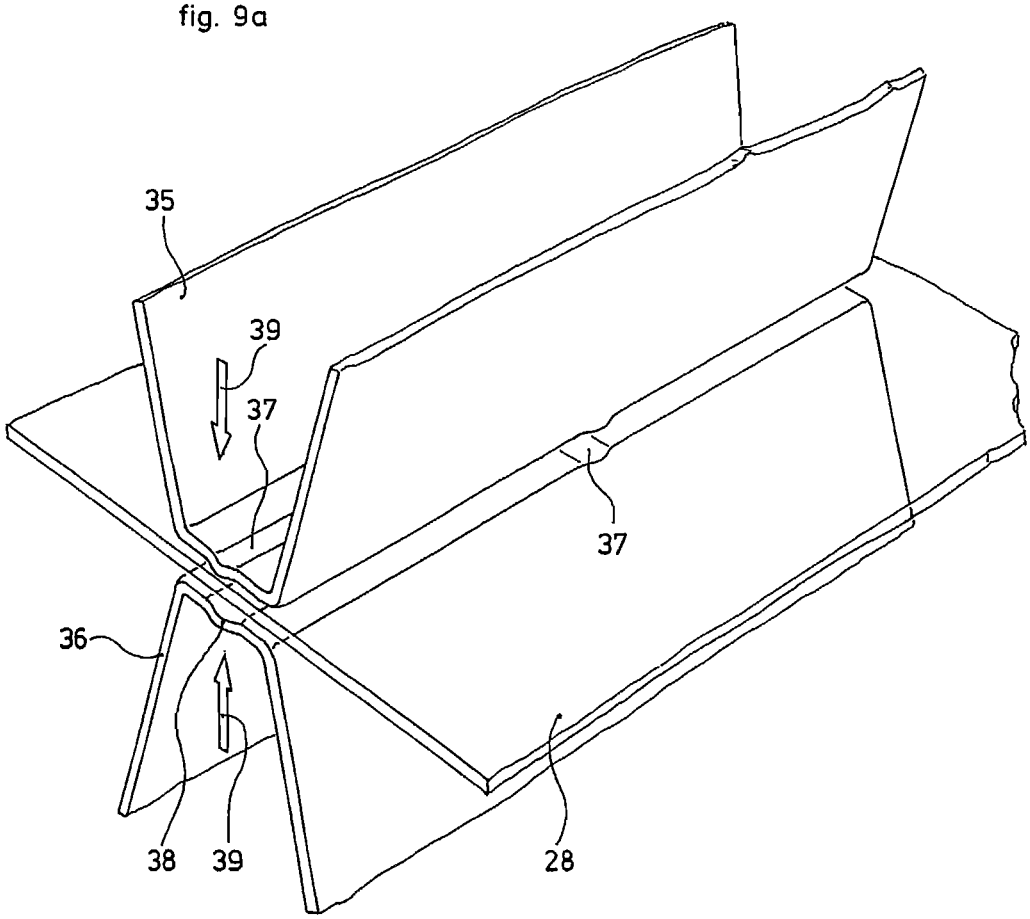
FIG. 9*b* is a perspective view of the preliminary stage of the structure according to FIG. 9*a;*
Figure 10A:
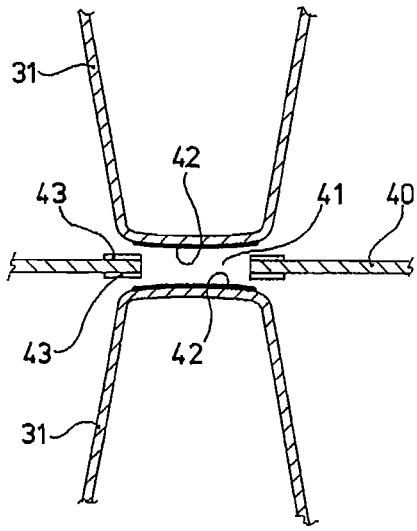
FIGS. 10*a* and 10*b* show views corresponding with FIGS. 7*a* and 7*b* respectively of an embodiment in which the fins are coupled directly to each other via holes in the membrane.
Figure 10B:
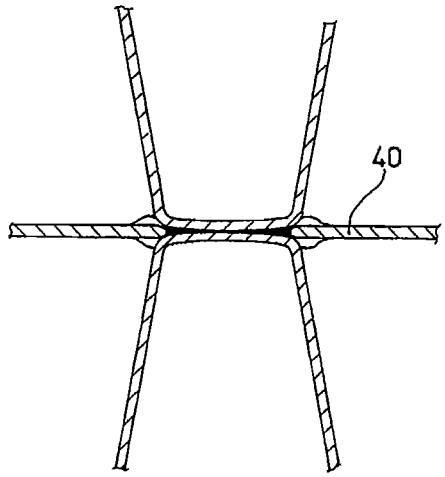
Figure 10C:
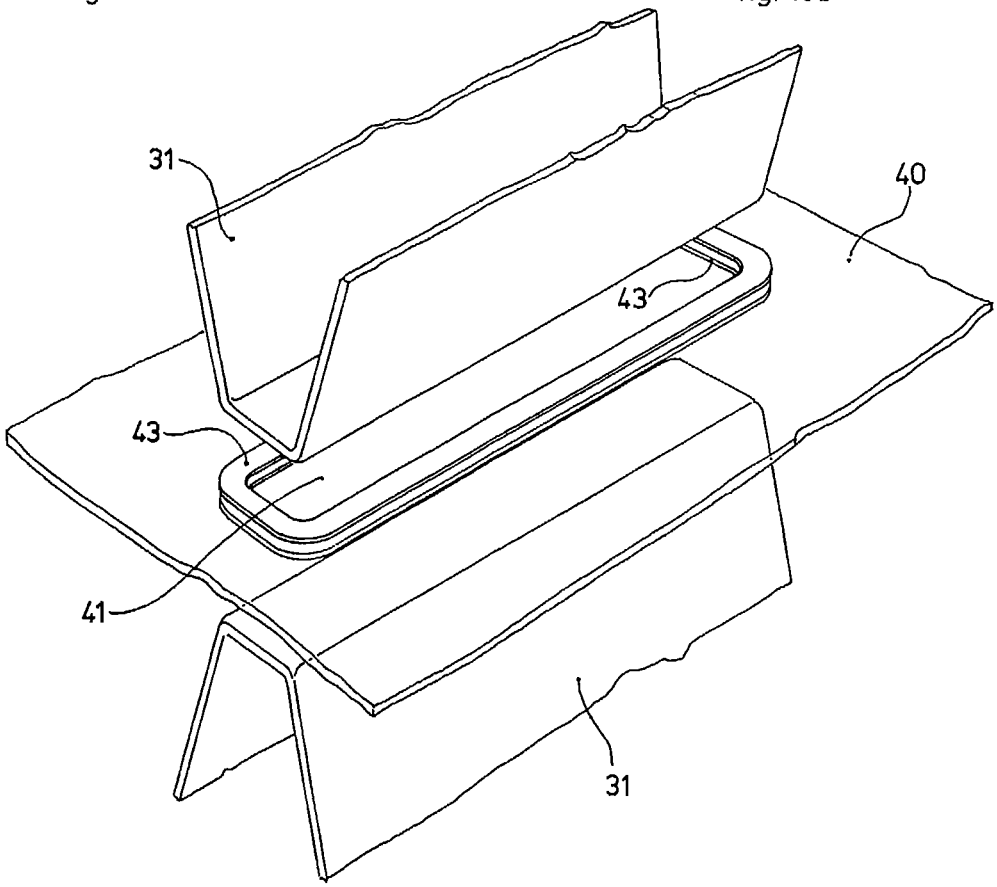
FIG. 10*c* is a perspective view of the phase shown in FIG. 10*a* and corresponding with FIG. 9*b;*

FIG. 9*a* shows a variant in which fins 35, 36 are provided with complementary corrugations 37, 38 respectively. A good positioning of the contact surfaces is hereby always ensured. The corrugations 37, 38 also extend in transverse direction. This aspect is clearly shown in FIG. 9*b*. Arrows 39 indicate that fins 35, 36 are forced together during heating and under pressure when membrane 28 is compressed. In the embodiment according to FIG. 10 membrane 40 is provided with openings 41, through which the contact surfaces of fins 31 can come into mutual contact. These contact surfaces are provided with adhesive layers 42, whereby the fins can be brought into direct mutual contact via these very thin adhesive layers, as shown in FIG. 10*b*. FIG. 10 also shows that the peripheral edge of opening 40 is provided with a mass 43 forming a sealing ring in order to ensure a medium-tight connection.

Figure 11:
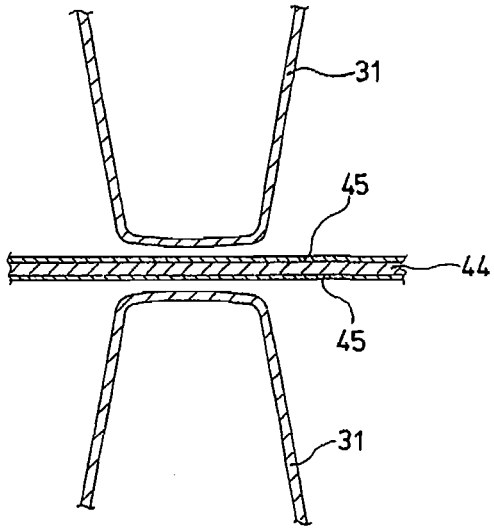
FIG. 11 shows the preliminary stage of an embodiment in which the membrane is provided on both sides with an adhesive layer.

FIG. 11 shows an embodiment wherein a membrane 44 is provided on both sides with an adhesive layer 45 for coupling to the contact surfaces of fins 31.

Figure 12:
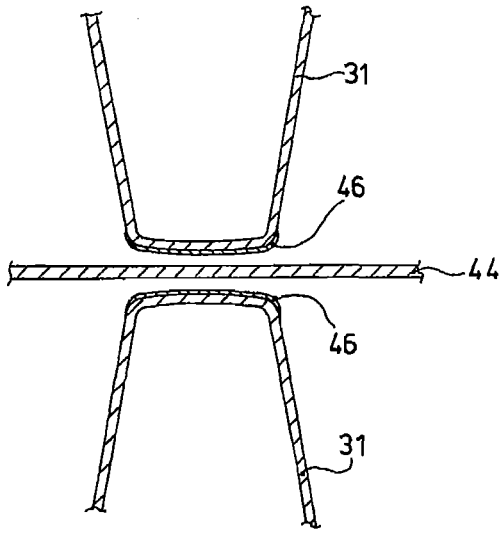
FIG. 12 is a view corresponding with FIG. 11 of an embodiment in which the contact surfaces of the fins are provided with a coating.

In FIG. 12 the contact surfaces of fins 31 are provided with adhesive layers 46.

Figure 13A:
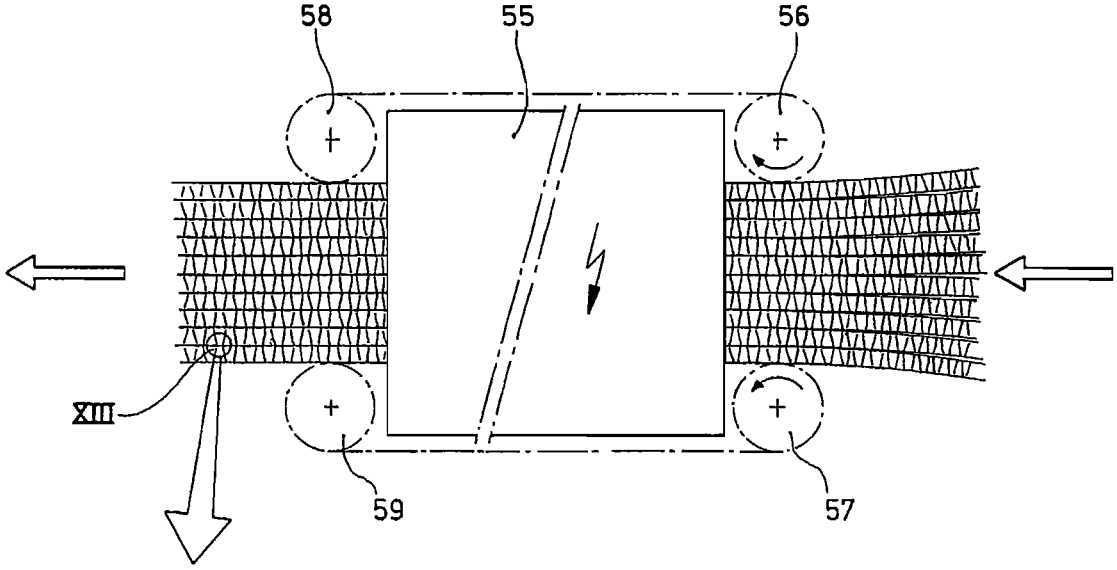
FIG. 13*a* shows a highly schematic view of a device for manufacturing a heat exchanger according to the invention in industrial manner.

FIG. 13 shows the manner in which the wall strips 48 and fin strips 49 adhered thereto can be assembled to form a package such as for instance drawn in FIG. 1.

Figure 13B:
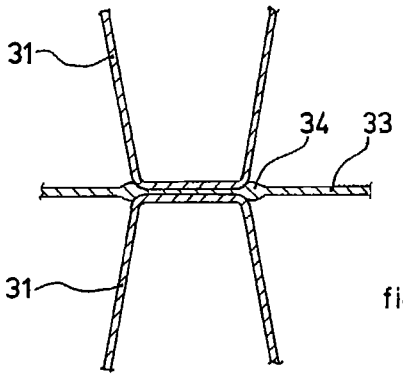
FIG. 13*b* shows detail XIII of FIG. 13*a* on enlarged scale.
Figure 13C:
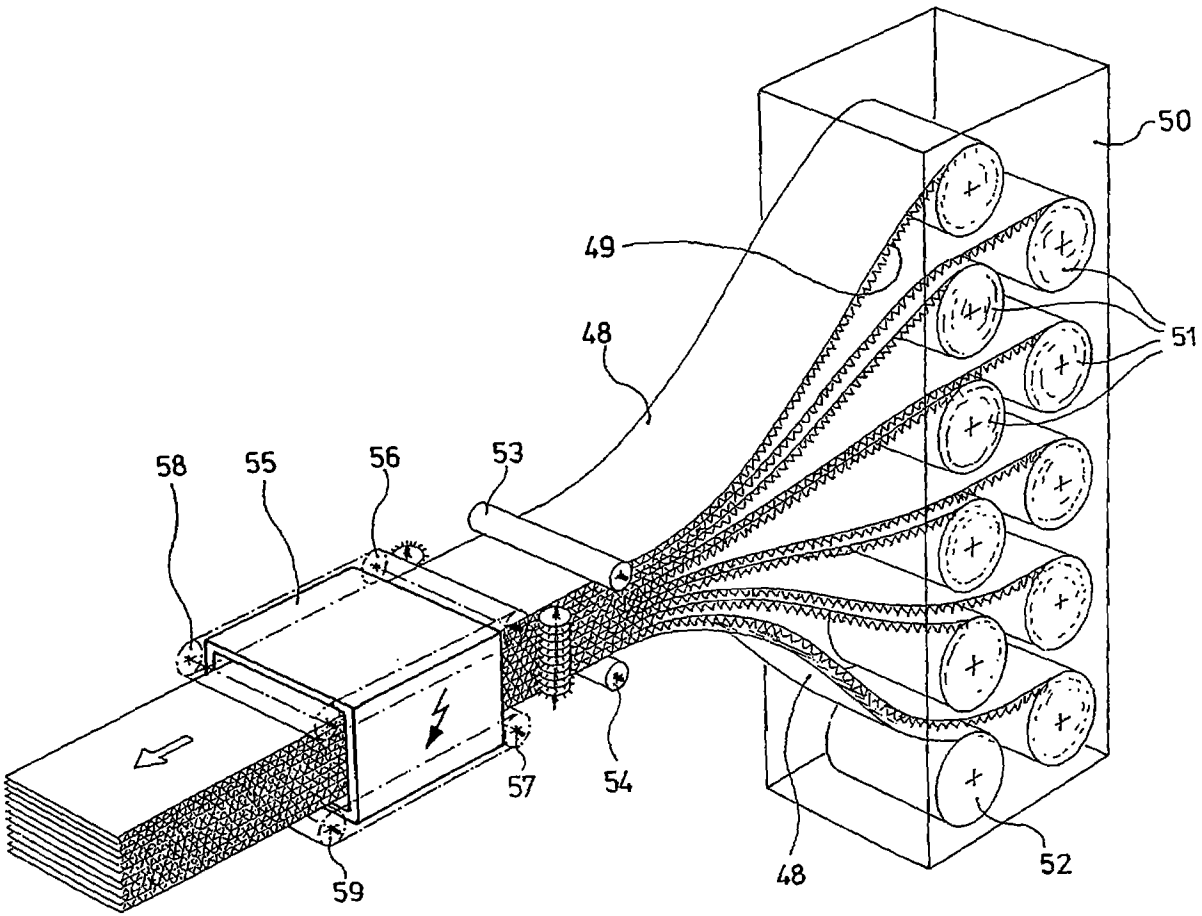
FIG. 13*c* shows a perspective view in slightly further developed and detailed form of the device of FIG. 13*a;*

As FIG. 13*c* shows, a supply container 50 contains ten supply roll 51 on which are glued wall strips with fin strips thereon. One of the rolls, which is designated with reference numeral 52, contains only wall material 48 without fins. The diverse strips are guided together through the pinch of two guide and pressure rollers 53, 54 and fed into an electromagnetic heating device 55, whereby the hot melt present on the relevant surfaces of the walls (FIG. 11) or the contact surfaces of the fins (FIG. 12) melts, so that the desired adhesion can be realized. Inlet pressure rollers 56, 57 and 58 contribute hereto.

FIG. 13*b*, which corresponds with FIG. 8, shows an embodiment in which the desired adhesion has been realized by pressure and temperature increase in device 55,56, 57,58, 59.

Figure 14:
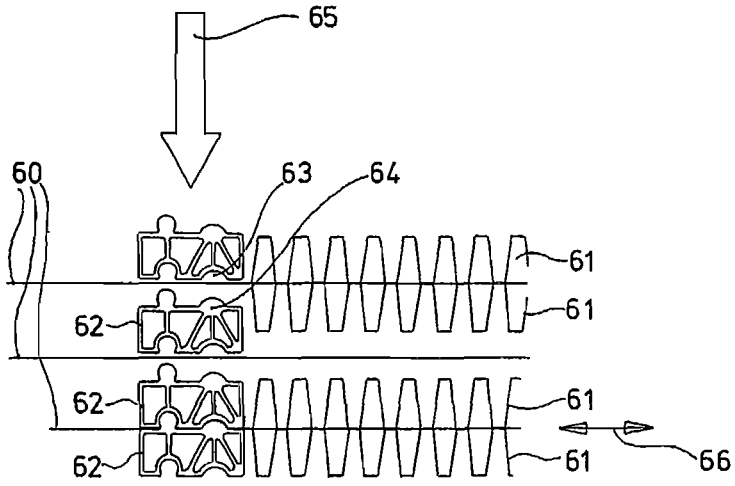
FIG. 14 shows a cross-sectional view of a part of a heat exchanger according to the invention during the production stage, wherein the membranes are fixed under tensile stress by means of tensioning means.

FIG. 14 shows walls 60 to which fins 61 are adhered. The walls can be positioned by means of snap profiles 62, wherein it is noted that, due to the respective recess 63 and the protrusion 64 co-acting therewith, a lengthening of the wall is realized which, together with the elasticity of the wall, results in a certain bias. By stacking the profiles 62 a heat exchanger 1 of the type according to FIG. 1 or of other type can be manufactured in modular manner. The pressing direction is shown symbolically with an arrow 65. Arrow 66 designates symbolically the mobility of the wall, wherein it should be understood that during pressing as according to arrow 65 a wall is stretched and thus placed under bias.

Figure 15:
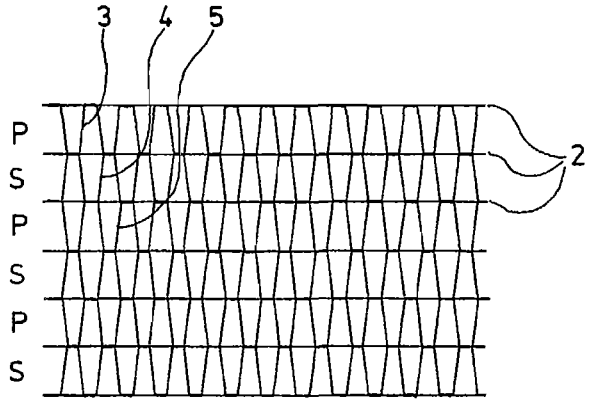
FIG. 15 shows a front view of a heat exchanger, wherein the fins and the medium circuits are ordered in a first arrangement.

FIG. 15 shows the structure shown in, among others, FIG. 1, wherein the primary and the secondary circuit follow each other.

Figure 16:
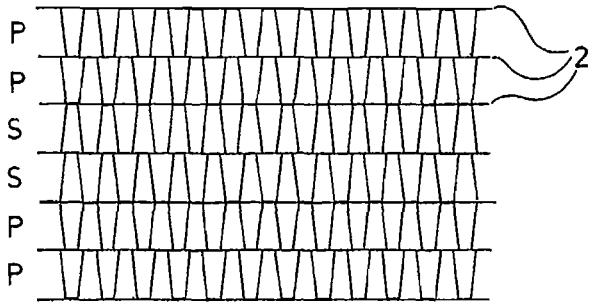
FIG. 16 shows a view corresponding with FIG. 15, wherein the fins and the medium circuits are ordered in a second arrangement.

FIG. 16 shows a variant in which two primary circuits are situated mutually adjacently, followed by two secondary, followed by two primary and so on.

Figure 17:
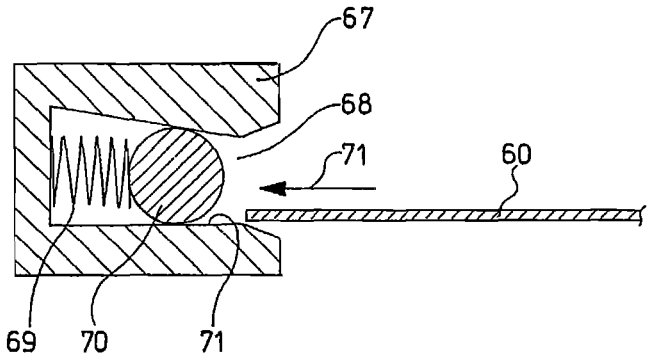
FIG. 17 shows a cross-sectional view of alternative tensioning means.

Finally, FIG. 17 shows an alternative to the method of clamping according to FIG. 14. In the embodiment according to FIG. 17, each of the clamping blocks 62 is embodied as a generally U-shaped profile 67 with an opening 68 narrowing to the outside in which is situated a roller 70 loaded by a compression spring. According to arrow 71 a wall strip 60 can be inserted into the pinch between the lower surface 71 of opening 68 and roller 70. While a slight pressure is exerted counter to the spring pressure of spring 69 the leading edge of wall 60 can hereby pass over the contact surface between surface 71 and roller 70. This arrangement takes place with some force, whereby the wall is slightly stretched until the required bias is achieved. The wall is then released and held fixedly in said pinch. This ensures a permanent bias.

Thus, the invention has been described by reference to certain embodiments discussed above. It will be recognized that these embodiments are susceptible to various modifications and alternative forms well known to those of skill in the art. Further modifications in addition to those described above may be made to the structures and techniques described herein without departing from the spirit and scope of the invention as defined by the claims.

What is claimed is:

1. Heat exchanger, comprising:

a plurality of walls of plastic material, the walls being held in spaced, generally parallel relation to form through-flow channels;

heat-conducting metal fins arranged between adjacent walls, which fins have a width extending between the walls and a length defining a flow direction, the heat-conducting metal fins being generally parallel to one another and structurally connected to the respective adjacent walls to maintain said spaced parallel relation and wherein the fins on a first side of a wall are each aligned with and in direct thermal contact with a corresponding fin on a second side of that wall, whereby heat conduction can take place from fin to fin through the wall;

wherein the fins within each through-flow channel are arranged in a plurality of strips, spaced and thermally separated from one another in said flow direction, the fins in each strip being spaced from each other by a pitch distance and the fins in a first strip being offset from the fins in an adjacent strip by a fraction of the pitch distance.

2. Heat exchanger as claimed in claim 1, wherein contact surfaces of the fins are directly connected to each other via a perforation in the wall.

3. Heat exchanger as claimed in claim 1, further comprising a form-retaining housing and the walls are connected to the housing in manner resistant to tensile stress, such that tensile stresses occurring in the wall can be absorbed by the housing.

4. Heat exchanger as claimed in claim 1, wherein the channels are designated alternately as primary and secondary channels and the heat exchanger further comprises a housing provided with two inlets and two outlets communicating with the respective primary and secondary channels.

5. Heat exchanger as claimed in claim 1, wherein the thermal resistance of the wall in its main plane over the mutual distance in the flow direction between fins in adjacent strips is at least 10 times greater than the thermal resistance of fins in thermal contact across the wall.

6. Heat exchanger as claimed in claim 1, wherein the walls comprise a fiber-reinforced material.

7. Heat exchanger as claimed in claim 1, wherein the walls comprise plastic in which aluminum powder is embedded.

8. Heat exchanger as claimed in claim 1, wherein the walls have a peripheral region free from fins such that they can be connected to a frame, in order to place said walls under bias, or such that the peripheral wall parts can be thermally formed into interlacing units and manifolds for respectively joining together and separating the sets of channels.

9. Heat exchanger as claimed in claim 1, wherein the heat exchanger has a modular structure comprising blocks which can be releasably coupled to each other to join adjacent walls.

10. Heat exchanger as claimed in claim 1, wherein the channels form a primary circuit P and a secondary circuit S and the walls are connected in layers ordered in the sequence P, S, P, S, P, S and so on.

11. Heat exchanger as claimed in claim 1, wherein the adhesive layer comprising an anticorrosive coating is applied extending over the whole surface of the fins.

12. Heat exchanger as claimed in claim 11, wherein the adhesive layer is of the type which can be thermally activated and that the fins are adhered to the corresponding fin by heat and pressure.

13. Heat exchanger as claimed in claim 12, wherein the fins are provided on the side remote from said contact surface with a second coating which can withstand said heating and pressure.

* * * * *